United States Patent [19]

Perkins, III et al.

[11] 4,314,645

[45] Feb. 9, 1982

[54] MECHANICAL REJECTION SYSTEM FOR AUTOMATIC SORTING MACHINES

[75] Inventors: Joseph R. Perkins, III, Roseville; Sylvester L. Woodland, Sacramento, both of Calif.

[73] Assignee: Sortex North America, Inc., Sacramento, Calif.

[21] Appl. No.: 114,669

[22] Filed: Jan. 23, 1980

[51] Int. Cl.[3] ..... B07C 5/00

[52] U.S. Cl. ..... 209/638; 209/657

[58] Field of Search ..... 209/638, 639, 656, 657, 209/653; 198/367, 597, 35 SS, 31 R, 31 A, 360, 361

[56] References Cited

U.S. PATENT DOCUMENTS 2,360,661 10/1944 Eddy et al. ..... 198/860

2,410,037 10/1946 Abbott ..... 209/657

3,460,664 8/1969 Bosse ..... 193/31 R

FOREIGN PATENT DOCUMENTS 2100297 9/1971 Fed. Rep. of Germany .... 193/31 R 58411 10/1967 German Democratic Rep. ..... 209/657

*Primary Examiner*—Allen N. Knowles

*Attorney, Agent, or Firm*—Cushman, Darby & Cushman

[57] ABSTRACT

A mechanical rejection mechanism for an automatic sorting machine has an inclined surface along which the objects to be sorted move by gravity. A separate section of the surface is movable outwardly by an operating mechanism responsive to an upstream sensor to push rejected objects off the surface toward a reject collecting station.

7 Claims, 2 Drawing Figures

Fig. 1.
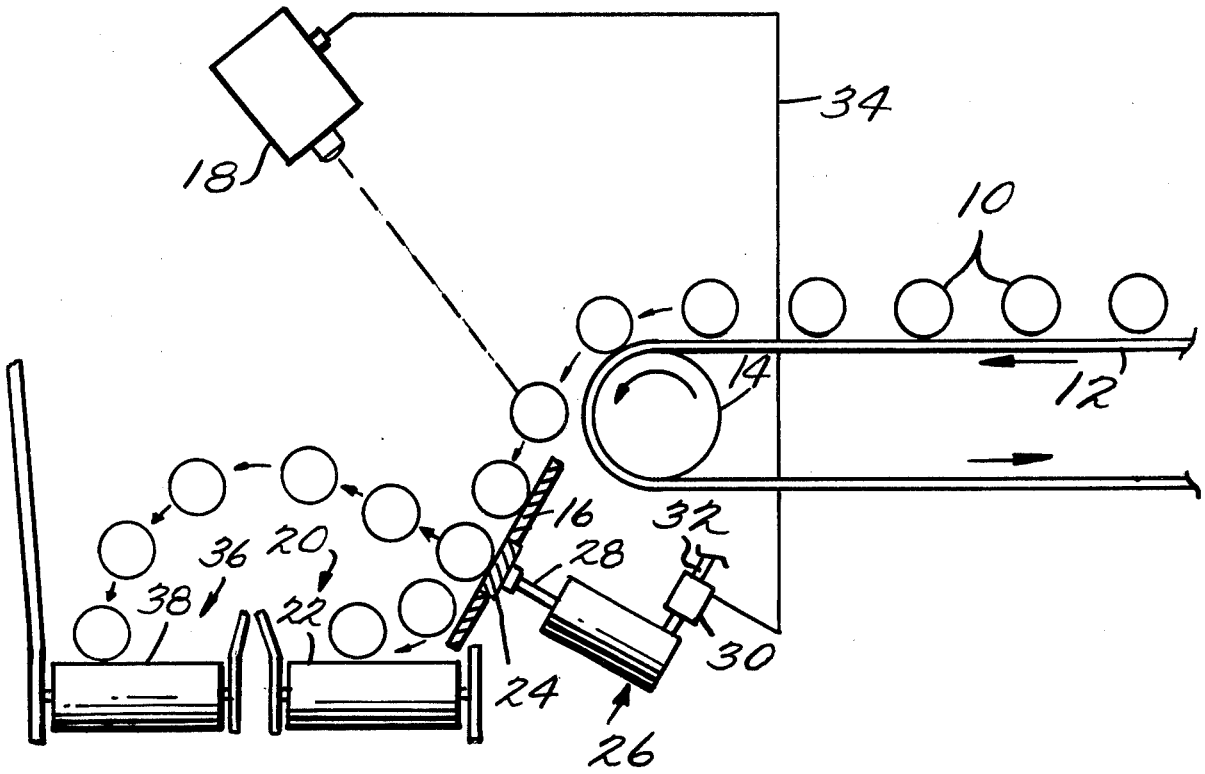
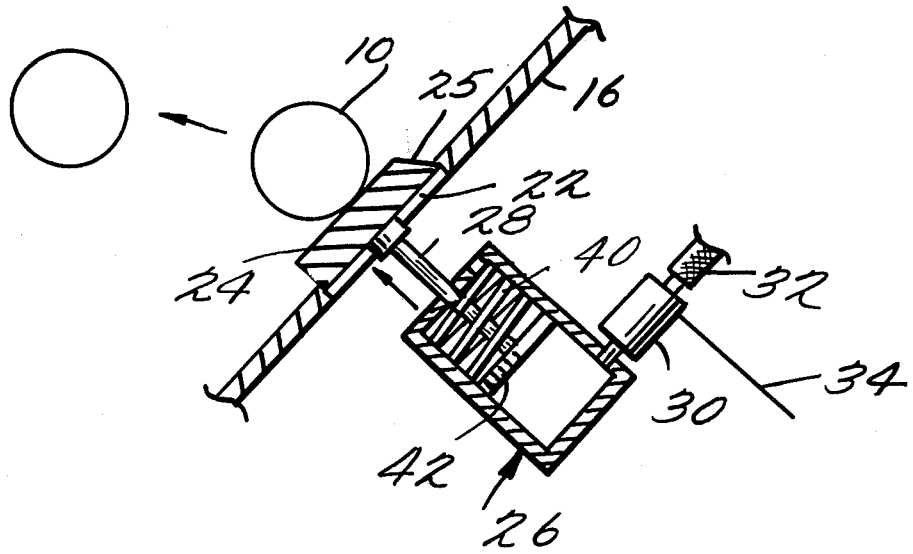
Fig. 2.

MECHANICAL REJECTION SYSTEM FOR AUTOMATIC SORTING MACHINES

FIELD OF THE INVENTION

This invention relates to improvements in automatic sorting machines and, more particularly, to improvements in ejector mechanisms for such machines.

BACKGROUND OF THE INVENTION

Automatic sorting machines cause objects or articles to travel along a path wherein the objects are scanned by known types of optical-electronic sensors which determine whether an object is acceptable or should be rejected. Downstream of the scanning location there are means actuated by the sensor to eject or divert an unacceptable object from its normal path of travel to a collection station for acceptable objects to a path which leads to a collection station for rejected objects, i.e., rejects. Many types of such rejection means or systems are known. Among these are those which use an air jet to reject or divert an unacceptable object from its normal path of travel. Exemplary of such air rejection systems are the disclosures of U.S. Pat. Nos. 2,967,614 and 4,035,636. While air rejection systems are practical and useful for machines for sorting small objects, e.g., raisins, nuts, rice grains, etc., they are impractical for sorting large objects such as tomatoes, oranges and other objects which may be intermingled with stones, dirt clods, etc. Jets of air of sufficient size and velocity to move such large objects create moisture and stir up dust which have a detrimental effect on the optical elements of the scanning sensors. Moreover, such air jets require large amounts of power so that they are particularly unsuitable for mobile sorting machines.

Mechanical rejection systems also are known. While they are fairly energy efficient, in general they have several disadvantages among which are short life, slow operation, and inflicting damage to the rejects. Mechanical rejection systems presently in use may be classified into three different types, "kicker", "bopper", and "deflector". A fourth type, the "trap door", is known but is not in general use because it is so slow, clumsy and expensive as to be impractical for commercial application.

The kicker type of mechanical rejection system is similar in a sense to a baseball bat. The "bat" or paddle is hinged at one end and operated by an air cylinder or an electric solenoid to knock an object out of its normal path of travel into a path which leads to a collecting station for rejects. Kicker systems have been used effectively for sorting objects such as tomatoes or onions from dirt clods. Dusty operating conditions, arising from dirt clods, however, tend to wear out the seals of air cylinders. Moreover, since scanning sensors are not perfect, sorters sometimes reject acceptable objects. For this reason, rejects frequently are run back through the sorting machine. Kicker rejection mechanisms have the disadvantage that they tend to damage anything they reject. For example, they will severely damage an otherwise acceptable tomato. Thus, kicker systems do not lend themselves to a rerun of rejects.

The bopper type of mechanical rejection mechanism is, in a sense, like a boxing glove mounted on the end of a piston rod of an air cylinder. This mechanism is simpler than that of the kicker type, but its life is shorter because the piston of the air cylinder must have a longer travel than that of the kicker mechanism because the latter takes advantage of a lever action to limit the extent of piston travel. Moreover, the bopper mechanism has almost the same reject-damaging defect as the kicker mechanism.

The deflector type of rejection mechanism is used wherein the normal path of travel of the articles or objects being sorted has a section involving a free-falling trajectory as disclosed, for example, in U.S. Pat. Nos. 4,095,696 and 4,155,456. When an object is to be rejected, a long paddle is projected into the free-fall section of the normal path to divert or deflect a rejected article to a different trajectory which leads to a station for collecting rejects. In this type of system very little, if any, damage is done to a rejected article. Consequently, in this system, rejected articles can be rerun through the sorting machine. This system is speed deficient, however, as compared to the kicker and the bopper systems. Furthermore, it is somewhat more complex than the bopper system since the deflector mechanism uses both a paddle and an air cylinder or solenoid.

The present trend in automatic sorting machines is away from so-called "channelized" systems toward so-called "random feed" systems. In channelized systems, objects to be sorted are arranged in one or more parallel rows, each of which is scanned by a separate sensor. In the random feed system, objects to be sorted are simply deposited at random on a flat conveyor belt and scanned with a multiplicity of sensors. This system avoids the mechanical complication of arranging the objects in rows and so increases the through put for a given width of machine. It will be seen that the random feed system requires the use of many rejectors to insure that it is possible to reject an unacceptable object without disturbing its acceptable neighbor. This requires that the rejection system be small, simple, low cost, and reliable.

BRIEF SUMMARY OF THE INVENTION

Accordingly, it is an object of this invention to provide a mechanical rejection system for automatic sorting machines that is relatively small, of simple and low cost construction, reliable in operation and which will minimize damage to a rejected object.

It is another object of this invention to provide such a rejection system that is fast in operation and has a long life.

The foregoing objects are accomplished by causing the scanned articles to travel, by gravity, along an inclined surface, and by providing the surface with a separate section, preferably rectangular and of approximately the same dimensions as the major dimensions of the outline of the objects to be sorted. The separate section of the surface is movable outwardly and upwardly thereof by an appropriate power mechanism, such as an air cylinder, actuable by an upstream scanning sensor to push an object moving along the surface outwardly of its normal path of travel toward a collecting station for rejects. This new and improved type of mechanical rejection mechanism may be termed "pusher" type.

Other objects and advantages of the invention will become evident from the following detailed description and accompanying drawing in which:

BRIEF DESCRIPTION OF THE DRAWINGS

FIG. 1 is a diagrammatic side elevational view of an ejector mechanism involving this invention for automatic sorting machines; and FIG. 2 is an enlarged fragmentary view, partly in section of a portion of FIG. 1.

DETAILED DESCRIPTION OF THE INVENTION

Referring now to the drawings, there is shown an improved rejection mechanism embodying this invention for use in an automatic sorting machine. The articles 10 to be sorted, for example, tomatoes, are arranged on a horizontal feed conveyor belt 12 which passes, at one end, over a roller 14 to discharge the objects onto a downwardly inclined plate 16 along which the articles move downwardly by gravity. Adjacent the upper end of the plate 16, i.e., at about the location where the objects 10 are being discharged from the feed belt 12, the objects are scanned, as indicated by the dashed line, by a known type of optical-electronic scanning sensor 18 which determines whether the scanned articles 10 are acceptable or unacceptable in accordance with predetermined criteria and, if unacceptable, develops a pulse signal which can be utilized to actuate a rejection mechanism. By way of example, the scanning sensor 18 may be of the type disclosed in the above-mentioned Pat. No. 4,095,696. At the lower end of the plate 16 is a station 20 for collecting acceptable objects, such as a horizontal conveyor belt 22.

Downstream of the scanning station the plate 16 is provided with a rectangular opening 22 (FIG. 2), having a width, i.e., a dimension transversely of the path of travel of the objects 10, approximately two-thirds the corresponding dimension of the smallest of the objects 10 to be sorted. For example, if the objects to be sorted are tomatoes, the width of the opening 22 will be approximately equal to two-thirds of the diameter of the smallest of the tomatoes being sorted. The other dimension of the opening 22, i.e., its length parallel to the path of the objects 10 is not too important and can be kept relatively small, e.g., 1 inch.

Disposed in the opening 22, and with its outer surface flush with the outer surface of the plate 16, is a reciprocable pusher plate or block 24, preferably of a tough light-weight plastic material. The block 24 is reciprocated by any appropriate means actuated on command by the signal developed by the sensor 18. For purposes of illustration there is shown in the drawings an air cylinder 26 for reciprocating the block 24. The cylinder 26 preferably is of the single-acting spring return type having the outer end of its piston rod 28 secured to the back of the block 24. A two-way solenoid valve 30 connected to the cylinder 26 normally communicates the latter with the atmosphere so that the outer surface of the block 24 is flush with that of the plate 16, as shown in FIG. 1. When energized, however, the valve 30 connects the cylinder 26 with a source of compressed air, via a supply conduit 32, thus quickly moving the block 24 outwardly.

When the sensor 18 scans an unacceptable article, the pulse signal is used to energize the solenoid valve 30 via electric lead 34. An appropriate time delay is provided in the sensor 18 so that the valve 30 will not be energized until the unacceptable object passes from the scanning station to a position in front of the block 24. At that time operation of the cylinder 26 as described above moves the block 24 quickly outwardly of the plate 16 so that the unacceptable object is gently thrown outwardly across the acceptable object collecting station 20, as shown in FIG. 1, to a rejected object collecting station 36 which may be in the form of a separate conveyor belt 38. As mentioned above, the sensor 18 is so constructed that the signal developed thereby is only a brief impulse so that the solenoid valve 30 is energized only briefly and immediately thereafter the spring 40 in the cylinder 26 retracts the block 24 to its normal position and thus allows acceptable articles to move thereover to the acceptable article collecting station 20.

Desirably, a number of such blocks 24, each with its own operating cylinder 26, solenoid valve 30, and separate scanning sensor 18 are arranged transversely across the plate 16. In other words, the opening 22 in the plate 16 is in the form of a rectangular cutout elongated transversely as respects the paths of travel of the objects 10 downwardly along the plate. The length of travel of the blocks 24 is relatively short but the blocks are thick enough so that when fully projected their sides will still be within the confines of the opening 22 in the plate 16 to minimize the creation of any gaps between the blocks and the plate through which dust and dirt could pass. In this same connection, it also will be seen that the clearances between the blocks and the plate 16 should be kept as small as possible to prevent dust and dirt from passing through such clearance onto the piston rod 28 and cylinder 26. Nevertheless, because the air cylinder 26 is single acting, with a spring return, no seal need be provided between piston rod 28 and the corresponding end of the cylinder, and the only seal necessary is that between the piston 42 and the cylinder. The sensors 18 are so arranged that a plurality of adjacent blocks 24, or even the entire array, may effect a simultaneous ejecting movement if the unacceptable object is relatively wide as compared to the width of the article to be rejected. Moreover, the simplicity of construction and operation is such that the rapidity or frequency of ejecting movement of the blocks 24 can be relatively high.

It also will be seen that in the aforedescribed rejection system a block 24 travels no appreciable distance in its rejecting movement before it encounters the object to be rejected. In other words, there is no impact of the rejector with the article to be rejected thus minimizing any possible damage to the article by its rejection. In some instances, it will be seen that the trajectory of the articles from the end of the feed conveyor 12 may be such that they may not actually contact and slide or roll along the plate 16 before reaching the block or even arriving at the acceptable article collection station 20. Nevertheless, the distance between the outer surface of the block 24 and an article to be rejected, at the time of a rejecting movement of the block, can be maintained at a minimum thus minimizing impact damage to a rejected article by the rejector. Preferably, the leading edge of each block 24 is bevelled at about 45° as at 25, as shown in FIG. 2, or alternatively rounded, to minimize the effect of impact therewith of, and consequent possible damage to, a closely following object 10 when a block is in its projected position.

While it will be seen that the rejected articles will fall upon the reject collection conveyor 38, damage as a result of such fall can be minimized by designing the reject collection station 36 to cushion the impact of any such fall, e.g., cushioning the conveyor 38 at that point with sponge rubber or the like (not shown). In any event, there will be no sudden rapid impact on an article to be rejected by the rejecting mechanism itself, as is the situation with kickers and boppers.

It thus will be seen that the objects and advantages of this invention have been fully and effectively achieved. It will be realized, however, that the foregoing specific embodiment has been disclosed only for the purposes of illustrating the principles of this invention and is susceptible of modification without departing from such principles. Accordingly, the invention includes all embodiments encompassed within the spirit and scope of the following claims.

We claim:

1. In an automatic sorter system wherein easily damaged delicate objects traveling along a path are scanned by optical-electronic sensor means to determine whether or not the object is acceptable or unacceptable, the combination of ejector means comprising:

means defining a generally planar, generally uninterrupted surface inclined to the horizontal along which scanned objects move by gravity along a substantially free-fall path to a station for collecting acceptable objects;

means defining a separate section of said surface downstream of the scanning location, said section being movable outwardly of said surface to push an object opposed to said section out of said path to a station for collecting rejected objects, said surface and said path being arranged so that the distance between the objects in said path and said section is kept to a minimum, whereby rejected objects are subjected to minimum impact by said section to avoid damage thereto; and means responsive to the sensor means for moving said section.

2. The system defined in claim 1 wherein the section defining means comprises tough, light-weight plastic material.

3. The system defined in claim 1 in which the section is reciprocable and the moving means comprises a single-acting air cylinder having a spring return.

4. The system defined in claim 1 in which the surface defining means is constructed and arranged so that the moving objects are in contact therewith and with the separate section to avoid impact of an object to be rejected by said section.

5. The structure defined in claim 1 in which there are a plurality of paths arranged side-by-side, a plurality of sensors, a plurality of separate sections arranged side-by-side transversely of the paths, and a plurality of moving means, one for each section.

6. The structure defined in claim 5 in which the width of each section, transversely of the paths, is of the order of two-thirds of the corresponding dimension of the smallest of the objects being sorted.

7. The structure defined in claim 1 in which the section defining means is of generally rectangular block-like configuration with its leading edge sloping rearwardly as respects the direction of travel of the objects to minimize possible impact therewith of, and damage to, a closely following object when the section is in its outward position.

* * * * *